United States Patent [19]

Dickinson et al.

[11] Patent Number: 5,028,213

[45] **Date of Patent: * Jul. 2, 1991**

[54] CONVERTIBLE AND VARIABLE-LENGTH GROUNDWATER DEVICES, COMPONENTS THEREFOR, AND METHODS OF CONSTRUCTING AND UTILIZING SAME

[75] Inventors: William D. Dickinson; James Mirand, both of Medina, N.Y.

[73] Assignee: American Sigma, Inc., Medina, N.Y.

[ * ] Notice: The portion of the term of this patent subsequent to Sep. 26, 2006 has been disclaimed.

[21] Appl. No.: 339,599

[22] Filed: Apr. 17, 1989

Related U.S. Application Data

[63] Continuation-in-part of Ser. No. 183,663, Apr. 19, 1988, Pat. No. 4,869,371.

[51] Int. Cl.[5] ..... F04B 21/08

[52] U.S. Cl. ..... 417/118; 417/238; 417/478; 417/554

[58] Field of Search ..... 417/238, 478, 554, 118, 417/137

[56] References Cited

U.S. PATENT DOCUMENTS

| | | | |
|---|---|---|---|
| 1,372,031 | 3/1921 | McKissick . | |
| 1,447,992 | 3/1923 | Layne et al. . | |
| 1,603,675 | 10/1926 | Folsom et al. . | |
| 2,078,322 | 4/1937 | Gage . | |
| 2,180,864 | 11/1939 | Connor . | |
| 3,034,440 | 5/1962 | Hermanson . | |
| 3,113,522 | 12/1963 | Coberly . | |
| 4,076,467 | 2/1978 | Persson . | |
| 4,439,113 | 3/1984 | Owen . | |
| 4,603,735 | 8/1986 | Black . | |
| 4,621,987 | 11/1986 | Spingath . | |
| 4,701,107 | 10/1987 | Dickerson et al. | 417/478 |
| 4,749,337 | 6/1988 | Dickerson et al. | 417/478 |
| 4,869,371 | 9/1989 | Dickerson et al. | 417/238 |

FOREIGN PATENT DOCUMENTS 0489533 1/1930 Fed. Rep. of Germany .

OTHER PUBLICATIONS

NWWA/EPA *Manual of Ground-Water Sampling Procedures,* published in 1981 US Department of the Interior Geological Survey Report, *Downhole Pumps for Water Sampling in Small-Diameter Wells,* published in 1979.

TIMCO Manufacturing Company, Catalog of Geotechnical, Ground Water Sampling Products, published in Mar. 1982.

*Primary Examiner*—Leonard E. Smith

*Attorney, Agent, or Firm*—Irving M. Weiner; Pamela S. Burt; Joseph P. Carrier

[57] ABSTRACT

A convertible and variable-length groundwater device permitting conversion of one type of groundwater sampling device to another, and vice versa. Conversion between a bailer device and a gas-drive pump, or a bailer device and a bailer pump, for example, is readily accomplished by substituting particular components from an assortment of universal, unique and multi-use components adapted to mate one with another and to be assembled substantially without the use of tools. Variable-length bladder devices, gas-drive pumps and bladder pumps are also provided, each being convertible between at least a single- and double-length assembly merely by adding or removing various components.

50 Claims, 4 Drawing Sheets

CONVERTIBLE AND VARIABLE-LENGTH GROUNDWATER DEVICES, COMPONENTS THEREFOR, AND METHODS OF CONSTRUCTING AND UTILIZING SAME

This is a continuation-in-part of application Ser. No. 183,663, filed Apr. 19, 1988, now U.S. Pat. No. 4,869,371.

BACKGROUND OF THE INVENTION

1. Field of the Invention

The present invention relates generally to convertible and variable length groundwater sampling devices or pumps, and kits of components therefor. More particularly, the invention relates to a plurality of selectively convertible groundwater devices of variable length, such as a single bladder pump, single gas-drive pump or single bailer; or a double bladder pump, double gas-drive pump, or double bailer, and kits of components for constructing same.

The basic groundwater device construction according to the invention includes a plurality of universal components, and any one of a plurality of sets of unique components. The terminology "universal components" as incorporated herein is intended to connote components such as pump bodies, pump body couplers, check valve assemblies, etc., each of which is adapted for interchangeable use in any one of a number of different groundwater sampling or pump assemblies in accordance with the invention. The terminology "unique components" as incorporated herein is intended to connote components which are substantially unique to or specific to a particular type of groundwater lift or pump assembly, such as a bailer, bladder pump or gas-drive pump.

By providing a plurality of different sets of unique components adapted for interchangeable use with the universal components of the invention, the invention affords maximum flexibility in converting from one type of lift or pump device to another merely by substituting one set of unique components for another to be operatively connected with the universal components.

2. Description of Relevant Art

In the art of groundwater sampling it is common to equip a well field with dedicated sampling equipment. The advantages afforded by dedicated equipment include: improved sample integrity; reduced sampling time and cost; elimination of troublesome cleaning procedures; and the ability to equip each well with the most efficient system for that well's specific characteristics. However, changing conditions or requirements often demand the use of groundwater sampling devices other than the device initially dedicated to a given well. For example, when a monitoring well is equipped with a bailer for sample collection, it may become necessary or desirable to use a pump capable of rapid and efficient purging, such as a gas-drive pump. Heretofore, it has been necessary to substitute one groundwater sampling device for another under such conditions, or to equipment the well with two different devices if possible, thus resulting in considerable expense and inconvenience.

There has also been a long-felt need in the groundwater sampling art to overcome the problems encountered by those working in the field in transporting equipment to the sampling site. A single sampling device will not satisfy all sampling needs encountered in the field, as evident when considering the role of groundwater sampling consultants, whose sampling activities take them to many different sites where the range of site-specific conditions demand a variety of different groundwater sampling devices.

Typically, a consultant carries in his truck a variety of discrete groundwater sampling devices, any one of which might be the one best suited for a given site. Because many water sampling sites are not accessible by truck, it is typically necessary for the consultant to manually transport a number of potentially useful sampling devices from his truck, parked some distance away, to the site. To manually transport the different lift devices, tubing, etc. which might be needed at the site may require the efforts of many workers or many trips by one person. Under the messy field conditions often found around sampling sites, a worker may find himself trudging through mud or clay as he hauls parts on repeated trips between the truck and the site. Indeed, he may even have to return to the lab to obtain necessary equipment not carried in his truck.

The following disclosed devices are illustrative of the types of essentially discrete lift assemblies adapted for use under particular site conditions, and thus plagued with the foregoing problems:

NWWA/EPA *Manual of Ground-Water Sampling Procedures,* published in 1981, discloses various bailers and gas-drive pumps each adapted to be used under particular groundwater sampling site conditions.

U.S. Department of the Interior Geological Survey Report entitled *Downhole Pumps for Water Sampling in Small-Diameter Wells,* published in 1979, discloses numerous downhole pumps for water sampling under particular small-diameter well conditions.

A catalog of geotechnical, groundwater sampling products from Timco Manufacturing Company, published in March 1982, discloses various groundwater sampling pumps and bailers.

U.S. Pat. No. 3,113,522 issued in 1963 to Coberly entitled "Convertible Fluid Operated Free Pump System" discloses a pump system for oil wells wherein conversion between a duplex and single pump requires removal of one pump, valve and set of passage units and then replacement with a different pump, valve and set of passage units.

The flexibility afforded by the groundwater sampling devices and components according to the present invention overcomes the foregoing problems attendant known lift and pump devices, and in so doing satisfies a long-felt need in the groundwater sampling art. With the present invention, a dedicated groundwater sampling device is not limited to the single type of device initially installed in the well, and instead can be easily and inexpensively converted to another type of device. Also in accordance with the invention, rather than transporting a number of potentially useful discrete devices to a site, a consultant or other user can simply transport a single kit of components which will afford him the flexibility to assemble the correct sampling device at the site itself.

The components according to the invention can be used to make, or to convert between, at least eight different pump or lift devices: 1) a relatively short single bladder pump; 2) a relatively long double bladder pump; 3) a relatively short single gas-drive pump; 4) a relatively long double gas-drive pump; 5) a relatively short single open-top bottom-filling bailer; 6) a relatively long double open-top bottom-filling bailer; 7) a relatively short single dual check valve bailer; or 8) a relatively long double dual check valve bailer. The novel components according to the invention also enable the user to conveniently assemble triple pump constructions, and even longer pump constructions if desired.

Another novel feature of the invention which renders same advantageous relative to known pump constructions is that the pump components can be assembled essentially without the use of tools. Thus, a pump of the desired structure can be assembled and disassembled at the site even while the consultant has protective gloves on. Because groundwater sampling professionals typically wear protective clothing including gloves, the ability to handle the components of the invention without tools or fine parts eliminates the need to remove gloves. Assembly/disassembly substantially without the use of tools also greatly facilitates cleaning and/or replacement of pump components. For example, a bladder assembly of the bladder pump can easily be removed and replaced, and check valves can be disassembled for cleaning, work on the check valve seat, etc.

The present invention thus solves a plethora of persisting problems in the groundwater sampling art which have not heretofore been satisfied by skilled persons.

The universal pump body of the present invention permits a single part to be used interchangeably as a pump body in different sampling devices (bailer, bladder pump, gas-driven pump), and permits convenient connection to additional universal pump body(s) for extending (e.g., doubling or tripling) the length of the pump. The universal pump bodies and other universal components of the invention also provide enhanced versatility, ease of assembly of components, and ease of disassembly and cleaning.

SUMMARY OF THE INVENTION

The present invention provides a convertible groundwater device adapted to be converted from a first device to a second device, and vice versa, the first device having a type of fluid conveying system which is different from fluid conveying system of the second device. The convertible groundwater device comprises at least one fluid-conducting component which comprises a component which is common to each of the first and second devices, lifting means for lifting water from a well to be monitored, and means for removably connecting the lifting means with the at least one fluid-conducting component such that water lifted by the lifting means passes through the at least one fluid-conducting component.

The first and second devices may comprise a bailer and a gas-drive pump, a bailer and a bladder pump, or a gas-drive pump and a bladder pump.

The invention also provides a convertible and variable-length groundwater device adapted to be converted from a first lift device to a second lift device, and vice versa, the first device having a type of fluid conveying system which is different from a fluid conveying system of the second device. The convertible and variable-length groundwater device comprises at least one first fluid-conducting component which is common to each of the first and second devices, at least one second fluid-conducting and length-extending component which is selectively connected to the first fluid-conducting common component to extend the length of the devices, lifting means for lifting water from a well to be monitored, and means for removably connecting the lifting means with the fluid-conducting components.

A variable-length bladder pump in accordance with the invention is convertible between a single-bladder configuration and a multiple-bladder configuration by employing first and second pump bodies, a pump body coupler, first and second bladder assemblies, and an internal coupling for interconnecting the bladder assemblies.

A variable-length gas-drive pump in accordance with the invention is convertible between a single gas-drive pump configuration and a multiple gas-drive pump configuration by employing first and second pump bodies, a pump body coupler, first and second water conduits, and a coupling member for interconnecting the water conduits.

A variable-length bailer in accordance with the invention is convertible between a single-bailer configuration and a multiple-bailer configuration by employing first and second pump bodies interconnected by a pump body coupler, and a bail adaptor removably connected to the upper end of the first pump body, the bail adaptor including means for attaching a bail line thereto.

The invention also provides a method of converting a groundwater bailer device to a groundwater pumping device having an internal pump structure, comprising the steps of removing a bailer member from an upper end of a universal pump body having a lower check valve assembly connected thereto, fitting an assembled internal pump structure in the pump body, connecting coaxial gas and water communication means with a top fitting, and connecting the top fitting to the upper end of the universal pump body such that the coaxial means communicates with the internal pump structure.

Further, the invention provides a method of increasing the length and pumping capacity of a groundwater pump device, comprising the steps of internally coupling a lower end of a first internal pump structure disposed in a first elongated pump body with an upper end of a second internal pump structure, inserting the second internal pump structure into a second elongated pump body, connecting a lower end of the first pump body with an upper end of the second pump body, connecting a lower check valve assembly to a lower end of the second pump body, connecting coaxial gas and water communicating means with a top fitting, and connecting the top fitting to an upper end of the first pump body such that the coaxial means communicates with the first and second internal pump structures.

It is an object of the invention to provide a groundwater device or system capable of providing maximum flexibility with respect both to the type of device constructed and the length and capacity of the device constructed.

A further object of the invention is to provide a groundwater device or system capable of being assembled substantially without the use of tools.

Another object of the invention is to provide various interchangeable components capable of being assembled into a wide variety of groundwater sampling devices.

The above and further objects, details and advantages of the invention will become apparent from the following detailed description, when read in conjunction with the accompanying drawings.

DETAILED DESCRIPTION OF PREFERRED EMBODIMENTS

Figure 7:
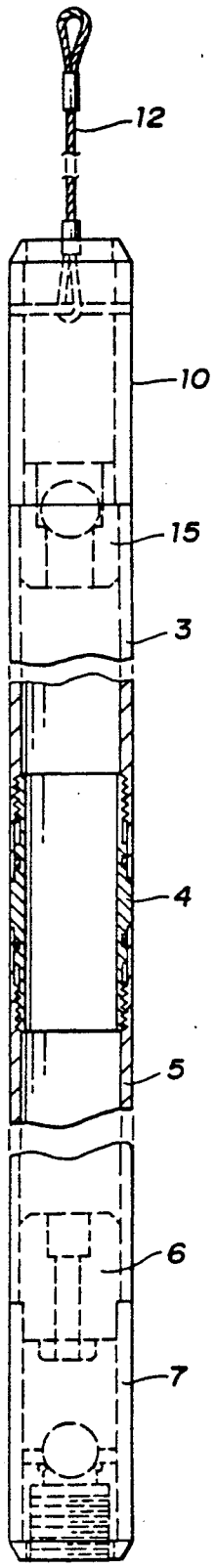
FIG. 7 illustrates a double bailer according to the invention.

The components and assembly of the bailer devices in accordance with the invention will be described with reference to FIGS. 1, 4 and 7.

Figure 1:
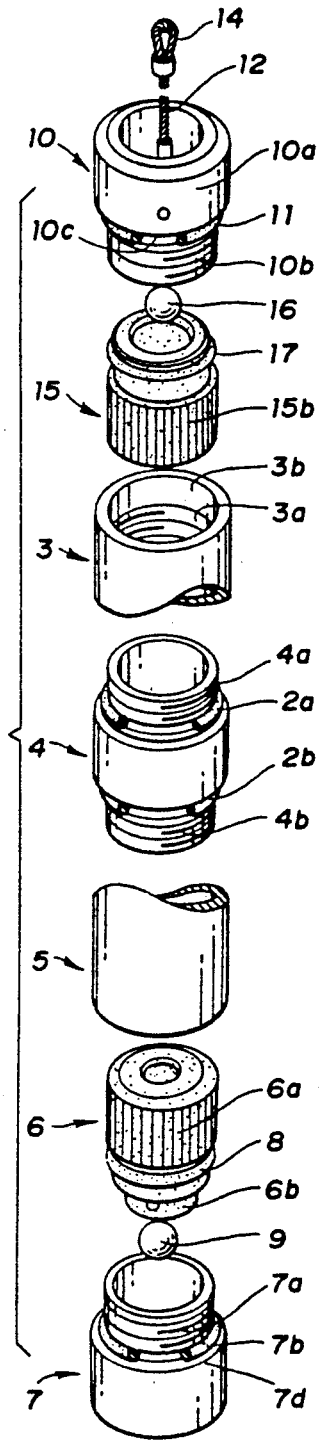
FIG. 1 shows the components for constructing a bailer in accordance with the invention.

With reference to FIG. 1, the components of a bailer according to the invention include a number of substantially unique bailer components, i.e., unique to the bailer, and a number of universal components which are not unique to the bailer and rather are adapted for universal use in any one of the groundwater sampling devices according to the invention.

The unique bailer components of FIG. 1 include a bail adaptor 10 and an upper check valve assembly 15.

Bail adaptor 10 may be fabricated of stainless steel or the like and comprises a hollow substantially cylindrical adaptor body 10*a* with an externally threaded lower portion 10*b* extending therefrom. A sealing member 11, which preferably comprises an O ring, is disposed in a groove on the outside of adaptor body 10*a* above threaded portion 10*b*. Bail adaptor 10 has an elongated support member or bail line 12 attached to an inside portion thereof for lowering the assembled bailer down a well, the attachment being made via a rod 13 (FIG. 4) passing transversely through adaptor body 10*a*. The upper end of support line 12 is looped at 14 for the fastening therethrough of means to lower the assembled bailer a further distance down a well, if necessary.

Upper check valve assembly 15 may be formed of plastic or the like, and is hollow and substantially cylindrical, having a constriction 15*a* (FIG. 4) on the inside lower portion thereof which defines a seat for an upper check ball 16. The outside lower portion 15*b* of valve assembly 15 has a knurled surface for gripping by the user during assembly. A sealing member 17, preferably an O ring, is disposed in a groove formed on an outside portion of assembly 15 above knurled lower portion 15*b*.

The bail adaptor 10 and upper check valve assembly 15 are dimensioned and shaped so that upper check valve assembly 15 may be gripped by a user at knurled portion 15*b* and sealingly inserted into the bottom of bail adaptor 10, a seal being formed between sealing member 17 and the inside wall of bail adaptor 10.

The components of FIG. 1, including upper check valve assembly 15 can be assembled to define a dual check valve bailer as described hereinbelow. By omitting upper check valve assembly 15, the bailer will be of the open top, bottom filling type.

The universal pump components of FIG. 1, which are adapted for universal use in each of the bailer and pump assemblies to be described below, include a first pump body 3, a pump body coupler 4, a second pump body 5, and a lower check valve assembly including a lower check ball retainer 6 and a lower check valve member 7.

The first universal pump body 3 comprises generally an elongated hollow cylinder formed of stainless steel, PVC, or other suitable material. The opposite end portions of pump body 3 are substantially identical and functionally interchangeable, each being formed with an internal threaded portion 3*a* spaced a distance from the end of pump body 3 such that a smooth inner wall portion 3*b* of pump body 3 extends between threaded portion 3*a* and the end of pump body 3.

Universal pump body 3 and bail adaptor 10 are relatively dimensioned so that the external threaded portion 10*b* of bail adaptor 10 is adapted to be threadably engaged with either one of the internal threaded portions 3*a* of pump body 3. Such relative dimensioning also applies to the various other unique pump components to be described hereinbelow, i.e., the threaded portions 3*a* of universal pump body 3 are dimensioned to threadably engage with threaded portions of upper bladder pump and gas-drive pump unique components described in detail hereinbelow.

In this respect, one of the advantages afforded by the present invention resides in the interconnectability of the universal components and the unique components of the various bailers and pumps, as well as the interconnectability of the universal components one with another. It will be understood that the various mating fastening portions of the components according to the invention generally have common diametrical dimensions and mating threaded portions so as to facilitate interchangeability of the various components and to enhance flexibility in assembling various bailer pump devices, as well as to facilitate conversion form one type of device to another, as will be described below.

With the threaded portions 10*b* and 3*a* threadedly engaged as described, hand-tightening of such connection will result is sealing member 11 being brought into sealing engagement with the smooth inner wall portion 3*b* of pump body 3. Also upon hand-tightening, an external seat portion 10*c* of bail adaptor 10 will abut against the upper end of pump body 3.

The universal pump body coupler 4 comprises generally a hollow cylinder formed of stainless steel, PVC, or other suitable material. Coupler 4 has substantially identical functionally interchangeable externally threaded end portions 4*a*, 4*b*, respectively. Sealing members 2*a*, 2*b*, preferably in the form of O rings, are disposed in grooves around the outside of coupler 4 a distance below threaded portion 4*a* and above threaded portion 4*b*, respectively., Universal pump body coupler 4 is adapted for use with universal second pump body 5 to form a double bailer device as shown in FIG. 7 and described in greater detail below.

The second universal pump body 5 is substantially identical to first universal pump body 3, although if desired the respective lengths thereof may differ. In this respect it will be understood that the term "double" bailer or pump as used herein is intended to cover not only an assembly wherein the pump body length is doubled with the addition of pump body 5, but also other assemblies in which the pump body length is extended to some other assemblies in which the pump body length is extended to some other extend, depending upon the number of pump bodies employed.

Similar to pump body 3, pump body 5 may be formed of stainless steel, PVC, or other material, and is provided with an internal threaded portion a distance from each end thereof with a smooth inner wall portion extending between each threaded portion and pump body end. As such, the respective ends of pump body 5 are functionally interchangeable in the same manner as the ends of pump body 3.

When universal pump bodies 3 and 5 are interconnected by coupler 4, the upper threaded portion 4*a* is threadedly interconnected with the lower threaded portion 3*a* of pump body 3, and the lower threaded portion 4*b* is threadedly interconnected with the upper threaded portion of pump body 5, such that the sealing members 2*a*, 2*b* are each sealingly engaged with respective smooth inner wall surfaces of pump bodies 3 and 5 upon hand-tightening.

The universal lower check valve assembly, including universal check ball retainer 6 and universal check valve 7, is adapted for universal use in any one of the bailer or pump assemblies according to the present invention, in the same manner as pump bodies 3, 5 and coupler 4. Check ball retainer 6 is preferably formed of plastic or other suitable material, is substantially hollow, and includes a knurled main body portion 6*a* for gripping by the user's hand. A sealing member 8, preferably in the form of an O ring, is fitted in a groove provided in the outside surface of retainer 6 below knurled portion 6*a*. A lower reduced diameter portion 6*b* of retainer 6 retains lower check ball 9 to prevent upward passage thereof.

The universal lower check valve 7 is generally a hollow cylinder formed of stainless steel, plastic, PVC, and/or other suitable material. An upper end portion 7*a* of check valve 7 is externally threaded, and is dimensioned to be threadedly engaged with the inner threaded end portions of either of pump bodies 3 or 5. Upon hand-tightening such engagement, a sealing member 7*b* (preferably an O ring) is brought into sealing engagement with the smooth inner wall end portion of either of pump bodies 3 or 5. Also upon hand-tightening, an external seat portion 7*d* of check valve 7 will abut against the lower end of pump body 3 (or 5). A lower portion of check valve 7 is provided with an inner constriction 7*c* (FIG. 4), defined by a plastic insert or the like, which defines a seat against which check ball 9 fits sealingly.

The check ball retainer 6 is dimensioned and shaped to fit sealingly inside check valve 7, i.e., such that sealing member 8 sealingly engages a smooth upper inner surface portion of check valve 7 and the lower edge of knurled portion 6*a* meets the upper edge of threaded portion 7*a*.

Figure 4:
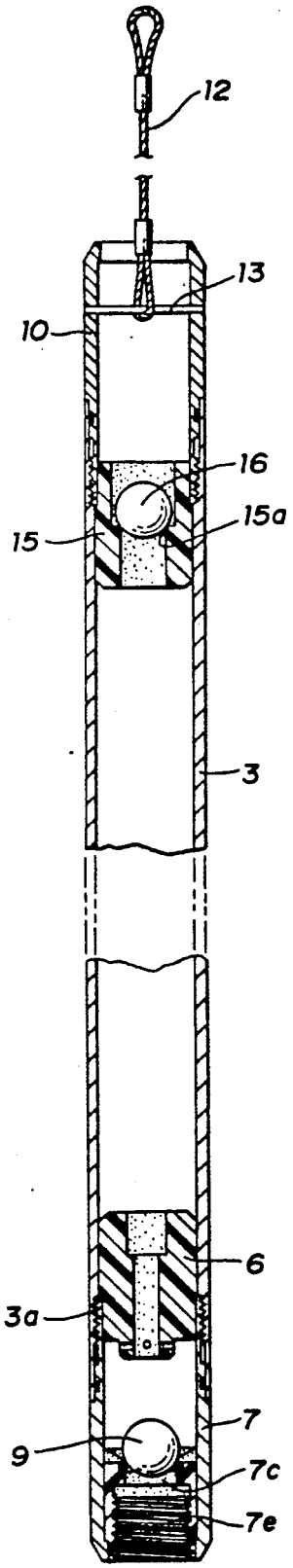
FIG. 4 is a view, partly in section, of an assembled single bailer incorporating a number of the components of FIG. 1.

As shown in FIG. 4, the lower portion of check valve 7 is provided with an internally threaded portion 7*e*, which may preferably be defined by the same plastic insert defining inner constriction 7*c*. It will be understood that the internally threaded portion 7*e* may be used for attaching suitably adapted fittings of auxiliary equipment (not shown) to any of the pump structures according to the invention, thus expanding versatility of the pumps. Such auxiliary equipment may comprise, for example, a screened intake attachment, a cleaning apparatus attachment, a booster system (e.g., to double lift) and/or other means for extending intake of the pump, etc.

To construct the single bailer assembly shown in FIG. 4, the unique bailer components and a number of the universal pump components described above with reference to FIG. 1 are employed. In this embodiment, the second universal pump body 5 and universal pump body coupler 4 are omitted because the bailer assembly is a single one.

In attaching bail adaptor 10 to the upper end of pump body 3, the upper check valve assembly 15 is first fitted by hand into the lower end of bail adaptor 10 until seal 17 sealingly engaged the inside wall surface of bail adaptor 10, and the upper end of knurled portion 15*b* abuts against the lower end of bail adaptor 10. The lower end of bail adaptor 10 with inserted check valve assembly 15 is then inserted into the upper end of pump body 3 and the threaded portions 10*b* and 3*a* are threadedly engaged. Hand-tightening of bail adaptor 10 will cause seal 11 to sealingly engage the inside smooth surface 3*b* of pump body 3.

To attach the lower check valve assembly to the lower end of pump body 3, retainer 6 is inserted by hand into the upper end of check valve 7 until seal 8 sealingly engages the inside surface of check valve 7 and the lower end of knurled portion 6*a* abuts against the upper end of threaded portion 7*a*. The upper end of check valve 7 with inserted retainer 6 is then inserted into the lower end of pump body 3 and the threaded portions 3*a* and 7*a* are threadedly engaged. Hand-tightening of check valve 7 will cause seal 7*b* to sealingly engage the lower inside smooth surface 3*b* of pump body 3.

It will be understood that the foregoing assembly operations may all be performed by hand, and likewise, disassembly of the various components may also be performed by hand, without requiring tools. If it is necessary to replace or clean the check valve assemblies, for example, the user has merely to disconnect the appropriate components to perform such operations.

The single bailer assembly of FIG. 4 is capable of ready conversion to an open-top, bottom filling bailer merely by omitting (or removing) upper check valve assembly 15. Ready conversion to a double bailer assembly can also be made with ease merely by interconnecting a first universal pump body 3 with a second universal pump body 5 via coupler 4, as shown in FIG. 7. In the double bailer assembly, the lower check valve assembly including retainer 6 and check valve 7 is threadedly engaged with the lower end of second pump body 5 as shown in FIG. 7, instead of the lower end of first pump body 3 as shown in the single bailer assembly of FIG. 4.

The overall length of the assembled single bailer shown in FIG. 4 may be, for example, approximately 40". The doubler bailer shown in FIG. 7 may have an overall length of, for example, approximately 78".

The components and assembly of the bladder pumps in accordance with the present invention will now be described with reference to FIGS. 2, 5 and 8.

Figure 2:
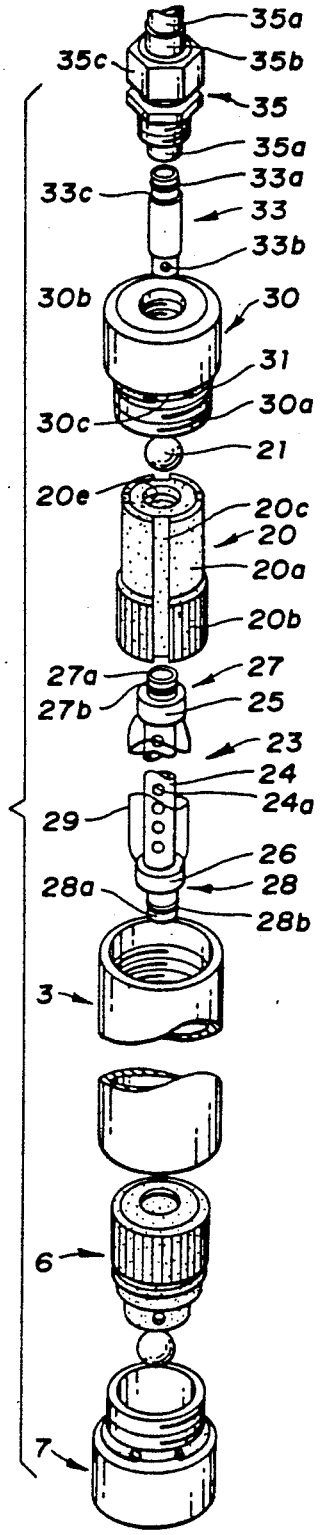
FIG. 2 shows the components for constructing a bladder pump in accordance with the invention.

The components shown in FIG. 2 include a number of unique bladder pump components, the universal components described above with reference to FIG. 1, and additional multi-use components.

The unique bladder pump components shown in FIG. 2 (i.e., those components which are unique to the bladder pump), include a bladder pump check valve assembly 20 and a bladder assembly 23.

The bladder pump check valve assembly 20 comprises a hollow substantially cylindrical check valve body 20*a* having an outer knurled portion 20*b* formed at the lower end portion thereof for gripping by the user's hands during assembly/disassembly. Four longitudinal grooves 20*c* are spaced equidistantly around check valve body 20*a* at 90 degree intervals, for the passage of air therethrough when the bladder pump is in operation. The check valve body 20*a* has a constriction 20*d* formed in an inner lower portion thereof (FIG. 5) to define a seat against which the check ball 21 fits sealingly. A seal member 20*e*, preferably an O ring, is disposed in a groove formed in an upper inside wall surface portion of check valve assembly 20.

Figure 5:
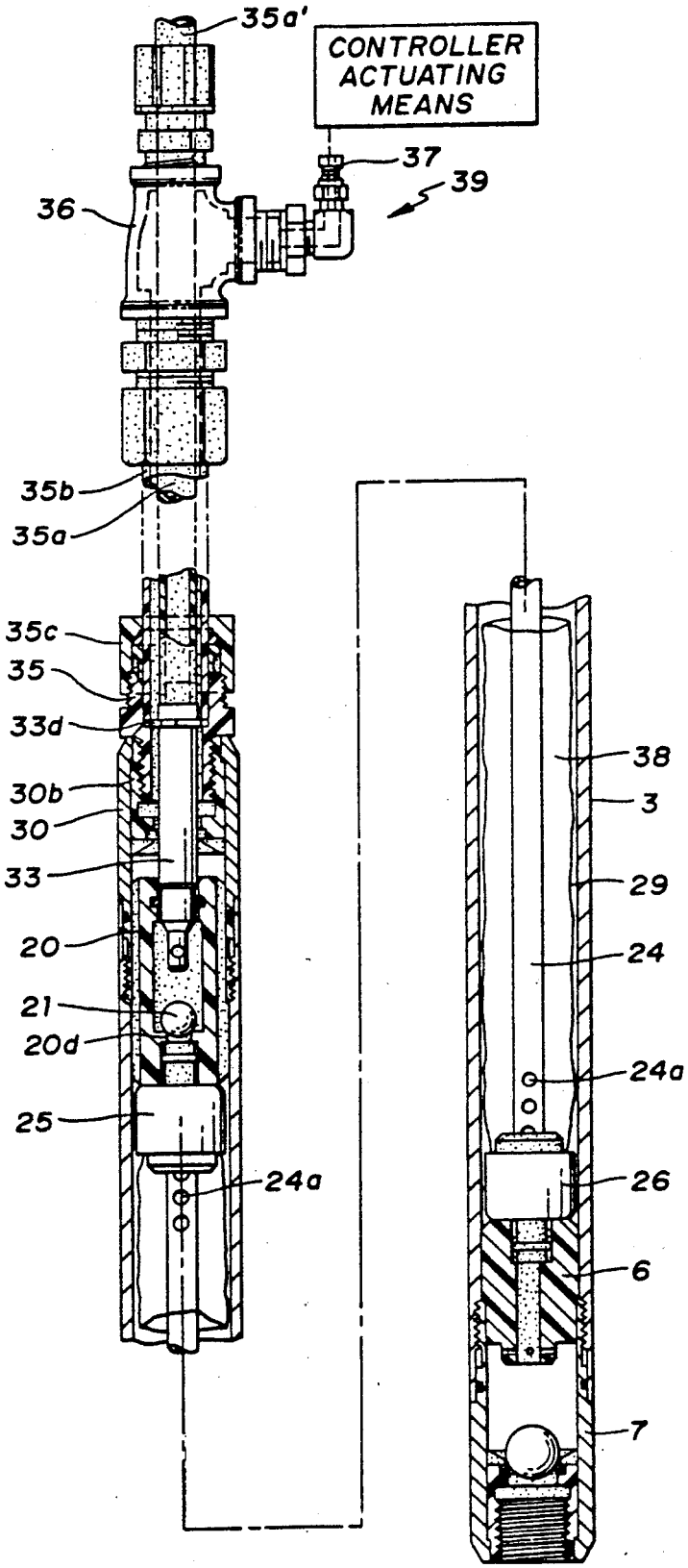
FIG. 5 is a view, partly in section, of an assembled single bladder pump incorporating the components of FIG. 2.

The bladder assembly 23 comprises a hollow rod 24 with a plurality of transverse holes 24*a* drilled therethrough so as to define a longitudinally spaced series of holes 24*a* adjacent each end of rod 24 (see FIG. 5). Opposite end caps 25, 26 securely mounted on bladder assembly end portion 27, 28, respectively, are fabricated of plastic or the like. The end portions 27, 28 each include an enlarged portion fitted over an end of rod 24 and having one of the caps 25, 26 in turn fitted thereon, and a reduced diameter portion 27*a*, 28*a*, respectively. Arranged coaxially relative to and around rod 24 is a substantially tubular flexible bladder 29 fabricated of teflon or other inert material. The respective ends of bladder 29 are retained between the enlarged portions of end portions 27, 28 and the end caps 25, 26 securely mounted thereof. Each of the reduced diameter portions 27*a*, 28*a* of the end portions 27, 28 has a sealing member 27*b*, 28*b*, respectively, mounted thereon, preferably an O ring mounted in a groove.

The universal components of the FIG. 2 bladder pump arrangement includes universal pump body 3 and the universal lower check valve assembly including retainer 6 and check valve 7, the details of which are set forth hereinabove with reference to FIG. 1. It will be understood that bladder assembly 23 described above is of a length to fit appropriately inside pump body 3, as will be discussed in greater detail below.

The multi-use components of the FIG. 2 bladder pump arrangement include a top fitting 30, a barbed fitting 33, a compression fitting 35, coaxial tubing 35*a*, 35*b*, and a coaxial tubing supporting and routing assembly 39. It will be understood that the terminology "multi-use" as applied to such components refers to the fact that the components can be used in either the bladder pump assemblies of FIGS. 5 and 8, or the gas-drive pump assemblies of FIGS. 6 and 9. Thus, whereas the "universal" components (e.g., pump bodies 3, 5, retainer 6 and check valve 7) are adapted for use in all of the bailer or pump assemblies according to the invention, the "multi-use" components are adapted for use in all but the bailer assemblies.

Top fitting 30 comprises a hollow substantially cylindrically-shaped member formed of stainless steel and/or plastic, or other suitable material. The lower portion 30*a* of top fitting 30 is externally threaded. A sealing member 31, preferably an O ring, is mounted in a groove provided in the outer surface of top fitting 30 a distance above threaded portion 30*a*. The upper inner wall portion 30*b* of top fitting 30 is also threaded, with a somewhat reduced diameter portion defined at a lower end of the threaded portion 30*b* and an O ring seal preferably provided at such reduced diameter portion (FIG. 5). The inner wall portion 30*b* with the lower reduced diameter portion may desirable be formed as a plastic insert to be fitted within the upper end of top fitting 30.

The compression fitting 35 with nut 35*e* operatively cooperate with and support a coaxial tubing arrangement wherein water may pass upwardly through the center conduit 35*a*, and air may pass downwardly through the space between the outside of center conduit 35*a* and the inside of outer conduit 35*b*. Conduits 35*a*, 35*b* are preferably constructed of plastic tubing which will not contaminate the groundwater being sampled. The lower portion of compression fitting 35 is externally threaded to mate with the inner threaded portion 30*b* of top fitting 30 as described below.

As shown in FIGS. 5, 6, 8 and 9, the coaxial tubing support and routing assembly 39 includes compression fittings attached to each side of a brass tee 36, for example, which supports an air line quick connect nipple 37. An arrangement of nuts, grip rings and ferrules formed of plastic, PVC or other suitable material may be employed for interconnecting the compression fittings to outer conduit 35*b* such that outer conduit 35*b* communicates through the brass tee 36 with nipple 37, and center conduit 35*a* extends upwardly to an upper end 35*a*' for discharging groundwater to collect samples thereof. In a permanently-installed groundwater sampling application, the well plate will typically be disposed just below brass tee 36.

The barbed fitting 33 is hollow and substantially cylindrical, preferably being formed of stainless steel or other noncorrosive metal. The upper end of barbed fitting 33 comprises a reduce diameter portion provided with at least one barb 33*a* around the circumference thereof, the barb 33*a* having a downwardly directed shaft edge. The reduced diameter upper portion of barbed fitting 33 is adapted to fit sealingly within the bottom end of center conduit 35*a*, with the barb 33*a* functioning to retain barbed fitting 33 within center conduit 35*a* once inserted, and to form a watertight seal therein. A circumferential seat 33*c* is defined in barbed fitting below barb 33*a* for supporting a retainer washer 33*d* (FIG. 5) with radial projections which abut against and support the lower end of outer conduit 35*b*. Barbed fitting 33 has through patterns 33*b* formed transversely therethrough near the bottom thereof to permit the passage of water therethrough should the check ball 21 inadvertently block-off the lower end of barbed fitting 33.

The various components of the bladder pump as described above are dimensioned and shaped for convenient interconnection and assembly, substantially entirely by hand, as follows.

Bladder assembly 23 is inserted into pump body 3 so as to extend substantially coextensively therethrough. The bladder pump check valve assembly 20 is then fitted onto the upper reduced diameter end portion 27*a* of bladder assembly 23, such that seal 27*b* sealingly engages the inner wall of check valve assembly 20. The lower check valve assembly, including check valve 7 and retainer 6 interconnected as described above, is then connected to the bladder assembly 23 by fitting the lower reduced diameter end portion 28*a* into the upper opening in retainer 6 such that seal 28*b* sealingly engages an upper inner wall portion of retainer 6. Threaded portion 7*a* of check valve 7 is threadedly engaged with the lower internal thread 3a of pump body 3 as described above.

With the assembly as thus far described, the upper end of bladder check valve assembly 20 will protrude somewhat from the upper end of pump body 3, while the bladder assembly 23 will be disposed entirely within pump body 3. With the upper end of barbed fitting 33 sealingly engaged within the lower end of center conduit 35a as described above, the top fitting 30 can then be attached to compression fitting 35 by threadedly engaging the inner upper threaded portion 30b with the externally threaded lower portion of compression fitting 35. The lower threaded portion 30a of top fitting 30 can then be threadedly engaged with the upper inner threaded portion 3a of pump body 3, such connection being hand-tightened until seal 31 sealingly engages the inner surface 3b of pump body 3. As such threaded connection is effected by hand tightening, the lower end of barbed fitting 33 will be tightly received within the upper end of bladder check valve assembly 20, such that seal 20e sealingly engages an outside lower surface portion of barbed fitting 33. Preferably, a circumferential seat portion may be provided on the outside surface of barbed fitting 33 so as to abut against the top edge of check valve assembly 20 when insertion of barbed fitting 33 into assembly 20 is complete. Also upon such hand-tightening, check valve assembly 20 will fit inside the lower end of top fitting 10 just until the top of knurled portion 20b of bladder check valve assembly 20 abuts against the bottom of threaded portion 30a of top fitting 30. When top fitting 30 is fully tightened on pump body 3, an outer seal portion 30c of top fitting 30 will abut against the upper end of pump body 3.

It will be understood that assembly of the bladder pump shown in FIG. 5 and described above need not necessarily be accomplished according to the foregoing order of steps, and rather any convenient logical order of assembly of the components can be adopted.

It will also be understood that access to the various components of the bladder pump as thus assembled is very convenient because disassembly is accomplished merely by reversing any one or more of the foregoing assembly steps. The field technician or other user can thus readily access the bladder assembly 23 for replacement thereof if necessary, while the other various components are also readily accessible for cleaning and/or replacement thereof.

When assembled as described above with reference to FIG. 5, the bladder pump includes an air pathway extending downwardly through outer conduit 35b, between barbed fitting 33 and the inner wall of top fitting 30, through grooves 20c of check valve assembly 20, and into an air chamber defined between the inner wall of pump housing 3 and the outside of bladder 29. The pathway for water, on the other hand, extends upwardly through the open lower end of check valve 7, through the valve opening when check ball 9 is unseated, through the longitudinal passage in retainer 6 and into rod 24, and outwardly through holes 24a into water chamber 38 defined within bladder 29.

When the air pathway is vented to the atmosphere, water is allowed to flow into the bladder water chamber 38, via open check valve 7, retainer 6 and holes 24a in hollow rod 24 under the influence of natural hydrostatic pressure. Thereafter, upon compression of bladder 29 by compressed air acting on the outside of same, water will be forced from water chamber 38 (closing check valve 7), and through holes 24a, upwardly through the central passage of check valve assembly 20, through barbed fitting 33, and through center conduit 35a to ultimately be expelled out the upper end 35a' of center conduit 35a for sample collection. The bladder pump thus functions to collect a groundwater sample under the alternate expansion and compression of bladder 29 in a known manner.

As shown in FIG. 5, the single bladder pump may be connected with a known controller actuating means via air line quick connect nipple 37. Such means may comprise, for example, a commercially-available pump cycle controller available from American Sigma, Inc. (model no. 5001). Such controller includes a compressed air supply means and cooperates with the single bladder pump during operation as follows.

When the pump is first introduced into the water of a monitoring well, the pump fills under the pressure of gravity forcing the water up through open check valve 7 into the empty bladder water chamber 38. Upon turning the controller on, it will immediately begin to pump compressed air through nipple 37 and the air pathway. Delivery of the compressed air results in water discharge as described above. An adjustable timer controls the amount of time that compressed gas or air flows to the pump, and is adjusted in accordance with such characteristics as the lift, tubing length, volume of the air tube and the compressed air source, so that compressed air is delivered until the pump is empty. If such time is set at four seconds, for example, after the four seconds of compressed air delivery has elapsed, the timer functions electrically to shut down and cause another time to actuate (e.g., by means of a directional air valve) to permit venting to the atmosphere which in turn allows the pump to re-fill with water. Such predetermined timed cycle will continue until water sampling is complete and the user shuts down the controller actuating means.

Turning from the single bladder pump assembly of FIG. 5 to the novel double bladder pump assembly according to the present invention, the structure and assembly steps of the double bladder pump will now be set forth with reference to FIG. 8.

Figure 8:
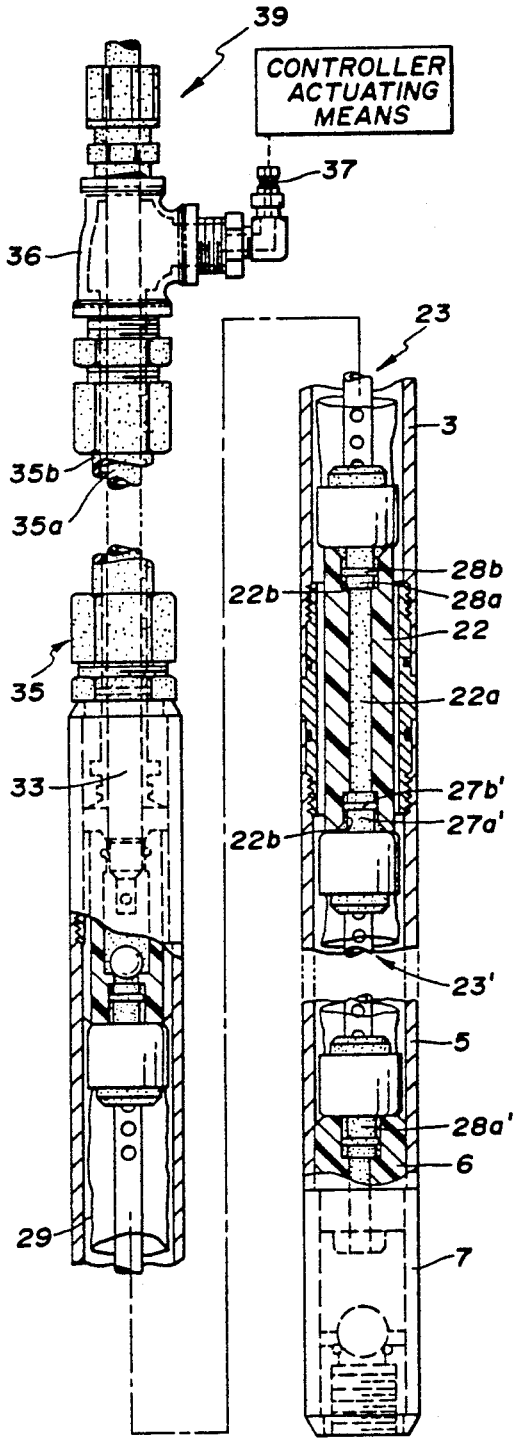
FIG. 8 depicts a double bladder pump according to the invention.

The double bladder pump assembly of FIG. 8 comprises two of the bladder assemblies 23 arranged in tandem, the lowermost bladder assembly being designated in FIG. 8 by reference numeral 23'. Assembly of the upper bladder assembly 23 in pump body 3 and lower bladder assembly 23' in pump body 5 is accomplished in essentially the same manner as described hereinabove with reference to FIG. 5 in connection with bladder assembly 23 and pump body 3. Also, assembly of the lower end structure including threaded attachment of the assembled combination of universal check valve 7/retainer 6 to the pump body is essentially the same as described hereinabove with reference to the single bladder pump of FIG. 5, except that in FIG. 8 the lower reduced diameter portion 28a' of lower bladder assembly 23' (rather than portion 28a of bladder assembly 23) is sealingly received in retainer 6 as the lower end of pump body 5 is threadedly fastened to the external threaded portion of check valve 7.

An internal coupler 22 having a substantially cylindrical shape is provided for coupling the bladder assemblies 23 and 23', as shown in FIG. 8. Internal coupler 22 may be fabricated of teflon tubing or the like, and has an inner longitudinal passage 22a which is slightly enlarged at each end portion 22b thereof and preferably terminates at each end with a chamfered portion as shown. The enlarged end portions 22b of passage 22a are adapted to closely receive therein the reduced diameter end portions 28a, 27a' of the bladder assemblies 23, 23' such that the respective seals 28b, 27b' are sealingly engaged with respective inner wall portions of passage end portions 22b. Internal coupler 22 thus functions to sealingly couple the bladder assemblies 23, 23' in tandem.

The external coupler of the double bladder pump assembly, i.e., the coupling together of pump bodies 3 and 5, is accomplished in essentially the same manner as described hereinabove with reference to the double bailer assembly of FIG. 7. It will be understood that such external coupling must be completed after the step of internally coupling bladder assemblies 23, 23' via coupler 22. By way of example, internal coupler 22 may first be sealingly engaged with only one of the bladder assembly ends 28a or 27a', and then coupler 4 may be threadedly engaged with the corresponding pump body end. Thereafter, the other end of coupler 22 may be sealingly engaged with the other bladder assembly end and the coupler 4 in turn threadedly engaged with the other corresponding pump body end. When the assembly is complete, internal coupler 22 will be coaxially disposed inside of pump body coupler 4, as shown in FIG. 8.

To complete the assembly of the double bladder pump of FIG. 8, it is necessary only to attach top fitting 30 to the upper end of pump body 3 as described above with respect to FIG. 5, and to in turn attach the coaxial tubing supporting and routing assembly 39.

The foregoing assembly steps for the FIG. 8 double bladder pump need not necessarily be followed in the above order, and rather any other convenient order may be followed. To facilitate coupling of bladder assemblies 23, 23' via internal coupler 22, however, it is desirable to defer attachment of top fitting 30 to pump body 3, or attachment of the lower valve assemblies 6, 7 to pump body 5, so that at least one of the bladder assemblies 23, 23' is free to slide within its respective pump body. In this manner, one of the bladder assembly ends can be temporarily projected out of its respective pump body to facilitate coupling of the bladder assemblies.

The double bladder pump of FIG. 8 is suitable for use instead of a single bladder pump in most applications. The primary advantage afforded by the double bladder construction is an increase in flow rate by approximately 30% to 35% or more. Such increased flow rate in turn affords the advantage of reduced operation time for collecting samples, and the attendant advantages of substantially reducing fuel costs and effectively doubling the length of service time intervals.

A shown in FIG. 8, the controller actuating means as described above with reference to FIG. 5 is also suitable for use with the double bladder pump.

The gas-drive pump assemblies in accordance with the invention, and the components used in constructing same, will now be described with reference to FIGS. 3, 6 and 9.

Figure 3:
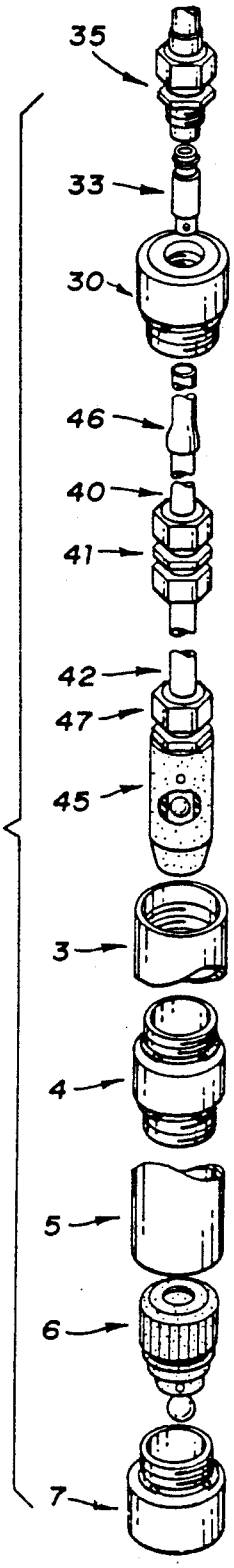
FIG. 3 shows the components for constructing a gas-drive pump in accordance with the invention.

As shown in FIG. 3, the gas-drive pump components comprise universal pump body 3, pump body 5 and pump body coupler 4 for the double gas-drive pump assembly, lower check ball retainer 6, and lower check valve 7. Also included are the multi-use components, i.e., top fitting 30, barbed fitting 33, compression fitting 35, and the various parts of the coaxial tubing supporting and routing assembly 39 (see FIGS. 6 and 9).

The unique gas-drive pump components includes, as shown in FIG. 3, an upper elongated conduit or tubing section 40, a substantially identical lower elongated conduit or tubing section 42 and a compression coupling 41 in the double gas-drive pump assembly, a dip tube check valve assembly 45, a connector conduit 46, and a compression coupling 47. The various conduits and compression couplings are preferably fabricated of plastic or other suitable material which will not contaminate the groundwater being sampled.

In the following description of the assembly steps for the single gas-drive pump assembly of FIG. 6 and the double gas-drive pump assembly of FIG. 7, it will be understood that interconnection of the various universal and multi-use components is accomplished in essentially the same manner as described hereinabove with respect to the bladder pump and bailer constructions.

Figure 6:
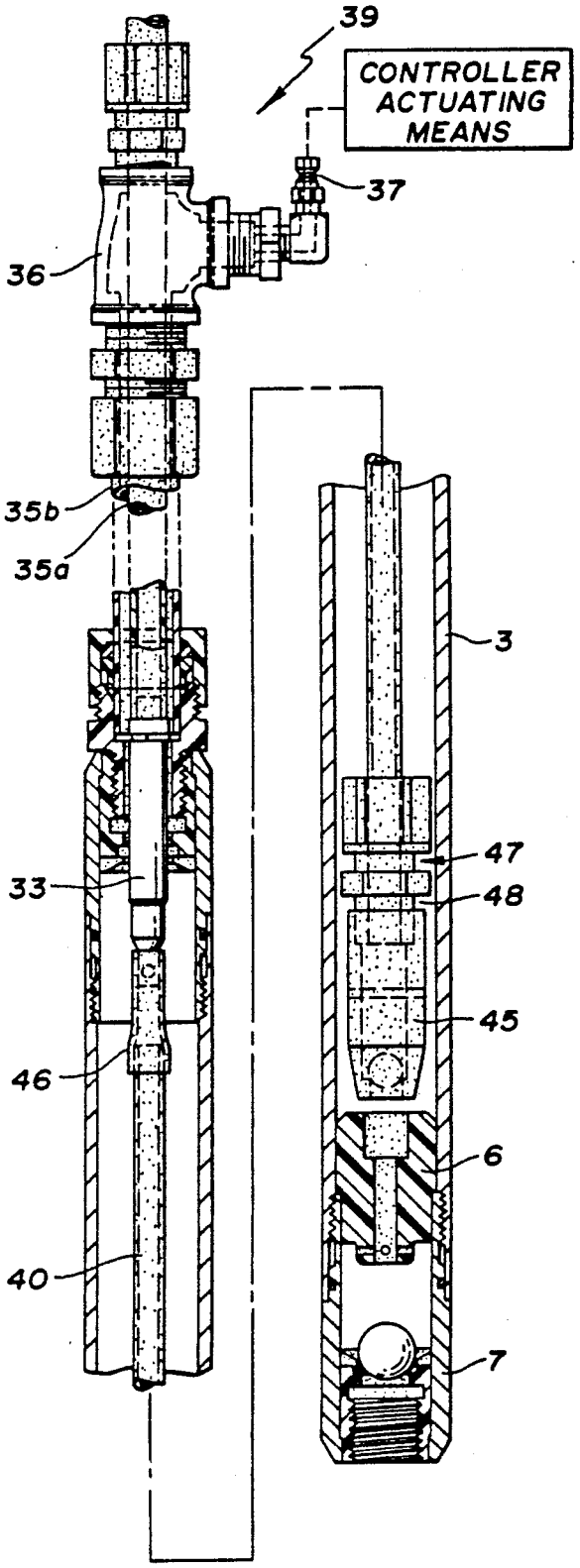
FIG. 6 is a view, partly in section, of a single gas-drive pump incorporating the components of FIG. 3.

As shown in FIG. 6, the connector conduit 46, fabricated of clear vinyl or the like, is sealingly fitted at the upper end thereof over the lower end of barbed fitting 33, and the lower end thereof is sealingly fitted over the upper end of conduit 40. The lower end of conduit 40 is connected with dip tube check valve assembly 45 via compression coupling 47, as shown in FIGS. 3 and 6. After such internal connections have been made, the top fitting 30 can be threadedly engaged with pump body 3 as described above. The combination lower valve assembly including retainer 6 and check valve 7 is threadedly engaged with the lower end of pump body 3 as described above.

It will be understood that the steps of assembly need not necessarily be accomplished in the foregoing order, and any other convenient of steps may be followed instead.

During operation of the single gas-drive pump of FIG. 6, first, the lower check valve 7 is open to permit water to enter through the passage in retainer 6 into the fluid chamber 48 defined within pump body 3. Thereafter, when air under pressure is introduced into the top of fluid chamber 48 via outer conduit 35b, the water in chamber 48 will be forced downwardly so as to close check valve 7. Under such force, the water then passes upwardly through open dip tube check valve assembly 45 and the center conduit 35a to be discharged out of the upper end of conduit 35a.

As shown in FIG. 6, the controller actuating means described above with reference to FIG. 5 may also be used in controlling and actuating the operation of the gas-drive pump.

Figure 9:
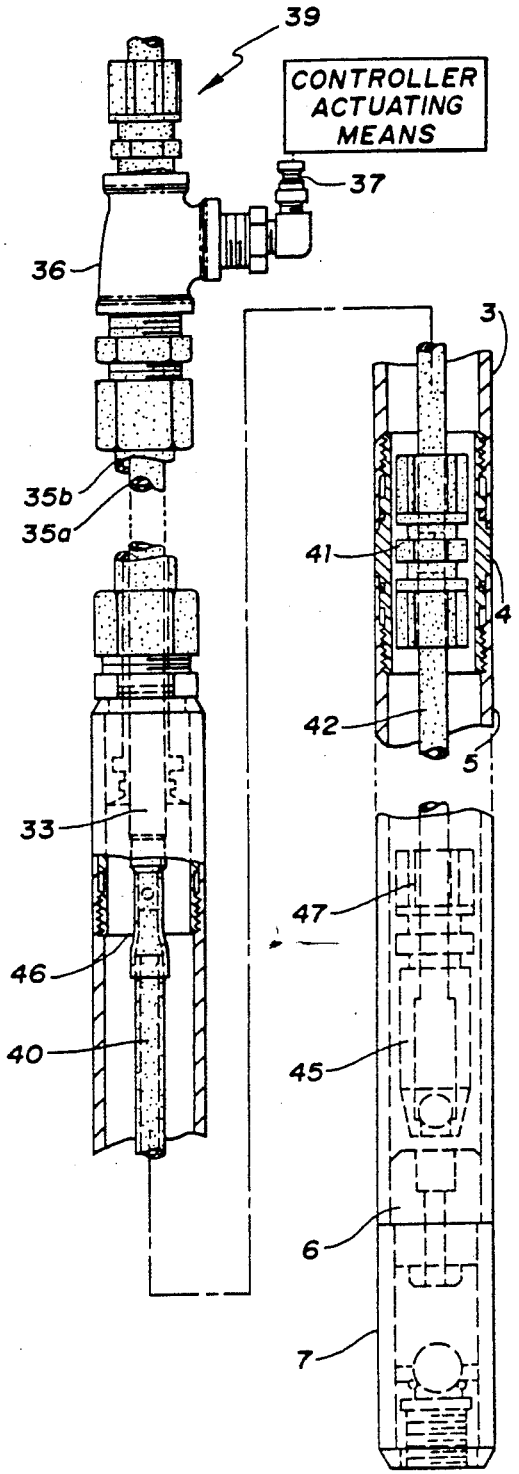
FIG. 9 shows a double gas-drive pump according to the invention.

Turning to the double gas-drive pump of FIG. 9, the foregoing FIG. 6 assembly steps are followed, together with the additional steps of coupling the lower end of conduit 40 to the upper end of conduit 42 via compression coupling 41, and connecting the pump bodies 3 and 5 via pump body coupler 4. Here again, any convenient order of assembly steps can be followed, although generally most of the external connecting steps are best accomplished after necessary internal connections have been effected.

The double gas-drive pump of FIG. 9 is suitable for use in most applications, and affords the advantages of increased flow rate, reduced fuel costs, and lengthened service time intervals.

As shown in FIG. 9, the controller actuating means described above with reference to FIG. 5 may also be used for controlling and actuating the double gas-drive pump of FIG. 9.

It will be understood that the bailer, bladder pump and gas-drive pump assemblies in accordance with the invention are not limited to single and double constructions as described in detail above, and if desired the assemblies can be expanded to triple-length or longer constructions by employing additional universal pump bodies 5, pump body couplers 4, and internal coupling members.

As described above, each of the single bailer, bladder pump and gas-drive pump devices of the invention may be readily converted to double devices merely by the addition of the various components described for the double devices. Such length-extending operations can be accomplished primarily by hand, without the use of tools, due to the convenient threaded interconnections between the various components.

The various devices are also readily convertible from one groundwater device to another merely by interchanging appropriate components, For example, to convert from a bailer to a gas-drive pump, the user has merely to remove bail adaptor 20 from the upper end of pump body 3, insert the assembled internal gas-drive pump means including conduit 40 and dip tube check valve assembly 45 into pump body 3, connect barbed fitting 33 with conduit 40 via connector conduit 46, attach compression fitting 35 to barbed fitting 33, and attach top fitting 30 to the upper end of pump body 3.

Similarly, to convert from a bailer to a gas-drive pump, the user has merely to remove bail adaptor 10 from the upper end of pump body 3 and the check valve assembly 6/7 from the lower end of pump body 3, and assemble and connect the internal bladder pump means as described above with reference to FIG. 5.

Conversion from a gas-drive pump to a bladder pump (and vice versa) is also conveniently accomplished merely by removing the gas-drive unique components described above and substituting therefor the unique bladder components (or vice versa) in accordance with the above-described gas-drive and bladder pump assembly steps.

Although there have been described what are at present considered to be the preferred embodiments of the invention, it will be understood that various modifications may be made therein without departing from the scope of spirit of the invention. The present embodiments are therefore intended to be illustrative, and not restrictive. The scope of the invention is indicated by the appended claims rather than by the foregoing description.

We claim:

1. A method of converting a groundwater bailer device to a groundwater pumping device having an internal pump structure, comprising the steps of:

removing a bailer member from an upper end of a universal pump body having a lower check valve assembly connected thereto;

fitting an assembled internal pump structure in said pump body;

connecting coaxial gas and water communicating means with a top fitting; and connecting said top fitting to said upper end of said universal pump body such that said coaxial means communicates with said internal pump structure.

2. A method according to claim 1, wherein:

said groundwater pumping device comprises a gas-drive pump, and said internal pump structure comprises a water conduit and a dip tube check valve assembly; and said method further comprises the step of assembling said internal pump structure by connecting said dip tube check valve assembly to a lower end of said water conduit, prior to said fitting step.

3. A method according to claim 1, wherein:

said groundwater pumping device comprises a bladder pump, and said internal pump structure comprises an internal bladder assembly and a bladder pump check valve assembly; and said method further comprises the steps of:

assembling said internal pump structure by connecting said bladder pump check valve assembly with an upper portion of said bladder assembly, prior to said fitting step; and connecting a lower end portion of said bladder assembly with an upper portion of said lower check valve assembly.

4. A method according to claim 1, wherein:

each of said removing, fitting and connecting steps is performed by hand, without the use of tools.

5. A method of increasing the length and pumping capacity of a groundwater pump device, comprising the steps of:

internally coupling a lower end of a first internal pump structure disposed in a first elongated pump body with an upper end of a second internal pump structure;

inserting said second internal pump structure into a second elongated pump body;

connecting a lower end of said first pump body with an upper end of said second pump body;

connecting a lower check valve assembly to a lower end of said second pump body;

connecting coaxial gas and water communicating means with a top fitting; and connecting said top fitting to an upper end of said first pump body such that said coaxial means communicates with said first and second internal pump structures.

6. A method according to claim 5, wherein:

said groundwater pumping device comprises a gas-drive pump, said first internal pump structure comprises a water conduit, and said second internal pump structure comprises a water conduit and a dip tube check valve assembly; and said method further comprises the step of assembling said internal pump structure by connecting said dip tube check valve assembly to a lower end of said second water conduit, prior to said step of connecting said lower check valve assembly.

7. A method according to claim 5, wherein:

said groundwater pump device comprises a bladder pump, said first internal pump structure comprises a first bladder assembly and a bladder pump check valve assembly, and said second internal pump structure comprises a second bladder assembly; and said method further comprises the steps of:

assembling said first internal pump structure by connecting said bladder pump check valve assembly with an upper portion of said first bladder assembly; and connecting a lower end portion of said second bladder assembly with an upper portion of said lower check valve assembly.

8. A method according to claim 5, wherein:

each of said coupling, inserting and connecting steps is performed by hand, without the use of tools.

9. A variable-length bailer convertible between a single-bailer configuration and a multiple-bailer configuration, comprising:

at least first and second elongated and substantially hollow pump bodies each having upper and lower end fastening portions;

said first and second pump bodies being substantially identical and interchangeable;

a bail adaptor removably connected to said upper end fastening portion of said first pump body, said bail adaptor including means for attaching a bail line thereto;

a lower check valve assembly;

said lower end fastening portion of said first pump body being adapted to be selectively connected to said lower check valve assembly in said single-bailer configuration; and said lower end fastening portion of said first pump body being adapted to be selectively connected to said second pump body in said multiple-bailer configuration.

10. A variable-length bailer according to claim 9, wherein said multiple-bailer configuration comprises:

a pump body coupler removably and sealingly connected between said lower end fastening portion of said first pump body and said upper end fastening portion of said second pump body;

said lower check valve assembly being removably connected to said lower end fastening portion of said second pump body.

11. A variable-length bailer according to claim 9, further comprising:

an upper check valve assembly removably connected between said upper end of said pump body and said bail adaptor, such that said bailer is of the dual check-valve type.

12. A variable-length gas-drive pump convertible between a single gas-drive pump configuration and a multiple gas-drive pump configuration, comprising:

at least a first elongated and substantially hollow pump body having upper and lower end fastening portions;

at least a first water conduit removably disposed in said first pump body;

a substantially hollow top fitting removably connected to said upper end fastening portion of said first pump body;

a lower check valve assembly;

a dip tube check valve assembly;

said lower end fastening portion of said first pump body being adapted to be selectively connected to said lower check valve assembly and said dip tube check valve assembly being adapted to be selectively connected to a lower end of said first water conduit in said single gas-drive pump configuration; and said lower end fastening portion of said first pump body being adapted to be selectively connected to said second elongated and substantially hollow pump body, and said dip tube check valve assembly being adapted to be selectively connected to a lower end of a second water conduit in said multiple gas-drive pump configuration.

13. A variable-length gas-drive pump according to claim 12, wherein said multiple gas-drive pump configuration comprises:

a second elongated and substantially hollow pump body having upper and lower end fastening portions;

a pump body coupler removably and sealingly connected between said lower end fastening portion of said first pump body and said upper end fastening portion of said second pump body;

said lower check valve assembly being removably connected to said lower end fastening portion of said second pump body;

a second water conduit having the upper end thereof removably connected to a lower end of said first water conduit by a coupling member, said second water conduit being disposed in said second pump body; and said dip tube check valve assembly being removably connected to a lower end of said second water conduit.

14. A variable-length gas-drive pump according to claim 13, wherein:

said first and second pump bodies are substantially identical and interchangeable; and said first and second water conduits are substantially identical and interchangeable.

15. A variable-length gas-drive pump according to claim 13, wherein:

a gas passage extends through said top fitting and into a fluid chamber defined in said first and second pump bodies outside said interconnected first and second water conduits.

16. A variable-length bladder pump convertible between a single-bladder configuration and a multiple-bladder configuration, comprising:

at least a first elongated and substantially hollow pump body having upper and lower end fastening portions;

at least a first elongated bladder assembly having upper and lower end portions, said first bladder assembly being removably disposed in said first pump body;

a bladder pump check valve assembly operably connected to the upper end portion of said first bladder assembly;

a substantially hollow top fitting removably connected to said upper end fastening portion of said first pump body;

a lower check valve assembly;

said lower end fastening portion of said first pump body being adapted to be selectively connected to said lower check valve assembly in said single-bladder configuration such that said lower end portion of said first bladder assembly is in fluid communication with said lower check valve assembly; and said lower end fastening portion of said first pump body being adapted to be selectively connected to a second elongated and substantially hollow pump body in said multiple-bladder configuration.

17. A variable-length bladder pump according to claim 16, wherein said multiple-bladder configuration comprises:

a second elongated and substantially hollow pump body having upper and lower end fastening portions;

a pump body coupler removably and sealingly connected between said lower end fastening portion of said first pump body and said upper end fastening portion of said second pump body;

said lower check valve assembly being removably connected to said lower end fastening portion of said second pump body;

a second bladder assembly having upper and lower end portions, said second bladder assembly being removably disposed in said second pump body; and an internal coupling sealingly and removably interconnected between said lower end portion of said first bladder assembly and said upper end portion of said second bladder assembly to provide fluid communication between said first and second bladder assemblies.

18. A variable-length bladder pump according to claim 17, wherein:

said first and second pump bodies are substantially identical and interchangeable; and said first and second bladder assemblies are substantially identical and interchangeable.

19. A variable-length bladder pump according to claim 17, wherein:

each said bladder assembly includes a hollow rod provided with a plurality of apertures, and a flexible bladder arranged coaxially around said rod and having the respective ends thereof secured to said upper and lower end portions of said bladder assembly, respectively to define a water chamber inside said bladder.

20. A variable-length bladder pump according to claim 19, wherein:

a water passage extends through said lower check valve assembly, said hollow rod and water chamber of said second bladder assembly, said internal coupler, said hollow rod and water chamber of said first bladder assembly, said bladder pump check valve assembly and said top fitting; and an air passage extending outside of said water passage through said top fitting, past outside portions of said bladder pump check valve assembly, into a first fluid chamber defined in said first pump body outside said bladder of said first bladder assembly, through said pump body coupler outside said internal coupler, and into a second fluid chamber defined in said second pump body outside said bladder of said second bladder assembly.

21. A convertible groundwater device adapted to be converted from a first device to a second device, and vice versa, the first device having a type of fluid conveying system which is different from a fluid conveying system of the second device, comprising:

at least one fluid-conducting component which comprises a component which is common to each of said first and second devices;

lifting means for lifting water from a well to be monitored; and means for removably connecting said lifting means with said at least one fluid-conducting component such that water lifted by said lifting means passes through said at least one fluid-conducting component.

22. A convertible groundwater device according to claim 21, wherein:

said first device comprises a bailer and said second device comprises a gas-drive pump.

23. A convertible groundwater device according to claim 22, wherein:

said at least one fluid-conducting component comprises an elongated and substantially hollow universal pump body, and a universal check valve assembly connected to a lower end of said pump body.

24. A convertible groundwater device according to claim 23 wherein:

said lifting means of said bailer comprises a substantially cylindrical and hollow bail adaptor removably connected to an upper end of said pump body, and means for attaching a bail line to said bail adaptor.

25. A convertible groundwater device according to claim 24, wherein:

said bailer further comprises an upper check valve assembly removably connected between said upper end of said pump body and said bail adaptor, such that said bailer is of the dual check-valve type.

26. A convertible groundwater device according to claim 24, wherein: said lifting means of said gas-drive pump comprises:

a substantially cylindrical and hollow top fitting selectively interchangeable with said bail adaptor for removable connection to said upper end of said pump body;

a water conduit disposed in said pump body;

means for communicating an upper end of said water conduit with a center conduit of a coaxial tubing arrangement;

a dip tube check valve assembly connected to a lower end of said water conduit; and a gas passage defined in part by an outer conduit of said coaxial tubing arrangement, said gas passage extending through said top fitting outside of said communicating means and into a fluid chamber defined in said pump body outside said water conduit.

27. A convertible groundwater device according to claim 6, wherein:

said gas passage of said gas-drive pump is operably connected with controller actuating means for automatically alternately supplying gas under pressure to said gas passage and venting said gas passage to the ambient in accordance with a predetermined timing cycle.

28. A convertible groundwater device according to claim 21, wherein:

said first device comprises a bailer and said second device comprises a bladder pump.

29. A convertible groundwater device according to claim 28, wherein:

said at least one fluid-conducting component comprises an elongated and substantially hollow universal pump body, and a universal check valve assembly connected to a lower end of said pump body.

30. A convertible groundwater device according to claim 28, wherein:

said lifting means of said bailer comprises a substantially cylindrical and hollow bail adaptor removably connected to an upper end of said pump body, and means for attaching a bail line to said bail adaptor.

31. A convertible groundwater device according to claim 30, wherein:

said bailer further comprises an upper check valve assembly removably connected between said upper end of said pump body and said bail adaptor, such that said bailer is of the dual check-valve type.

32. A convertible groundwater device according to claim 30, wherein: said lifting means of said bladder pump comprises:

a substantially cylindrical and hollow top fitting selectively interchangeable with said bail adaptor for removable connection to said upper end of said pump body;

an elongated bladder assembly disposed in said pump body and including a hollow rod provided with a plurality of apertures, and a flexible bladder arranged coaxially around said rod and having the respective ends thereof secured to respective end portions of said bladder assembly to define a water chamber inside said bladder;

a bladder pump check valve assembly operably connected to the upper end portion of said bladder assembly;

means for communicating an upper end of said bladder pump check valve assembly with a center conduit of a coaxial tubing arrangement;

a water passage extending through said universal check valve assembly, said hollow rod and water chamber of said bladder assembly, said bladder pump check valve assembly, said communicating means and said center conduit; and an air passage defined in part by an outer conduit of said coaxial tubing arrangement, said air passage extending through said top fitting outside of said communicating means, past outside portions of said bladder pump check valve assembly, and into a fluid chamber defined in said pump body outside said bladder.

33. A convertible groundwater device according to claim 32, wherein:

said air passage of said bladder pump is operably connected with controller actuating means for automatically alternately supplying air under pressure to said air passage and venting said air passage to the ambient in accordance with a predetermined timing cycle.

34. A convertible groundwater device according to claim 32, wherein:

said bladder assembly is removably disposed in said pump body, removably connected to said bladder pump check valve assembly at said upper end portion thereof, and removably connected with a portion of said universal check valve assembly at said lower portion thereof.

35. A convertible groundwater device according to claim 21, wherein: said at least one fluid-conducting component comprises:

at least one elongated and substantially hollow universal pump body; and a universal check valve assembly removably connected to a lower end of said pump body.

36. A convertible groundwater device according to claim 35, wherein: said universal check valve assembly comprises:

a lower check valve with a check ball seat formed therein;

a check ball; and a check ball retainer removably connected to an upper inner portion of said check valve such that a fluid-conducting passage of said check ball retainer communicates with a check valve passage of said check valve;

an upper outer portion of said check valve being removably sealingly connected to said lower end of said pump body such that said check ball retainer extends inside the lower end of said pump body.

37. A convertible groundwater device according to claim 36, wherein:

said fluid-conducting passage of said check ball retainer includes an upper end portion thereof adapted to removably and matingly receive a fluid-conducting portion of said lifting means.

38. A convertible groundwater device according to claim 21, wherein:

said first device comprises a bladder pump and said second device comprises a gas-drive pump.

39. A convertible groundwater device according to claim 38, wherein:

said at least one fluid-conducting component comprises an elongated and substantially hollow universal pump body, and a universal check valve assembly connected to a lower end of said pump body.

40. A convertible groundwater device according to claim 39, wherein: said lifting means of said bladder pump comprises:

a substantially cylindrical and hollow top fitting selectively interchangeable with said bail adaptor for removable connection to said upper end of said pump body;

an elongated bladder assembly disposed in said pump body and including a hollow rod provided with a plurality of apertures, and a flexible bladder arranged coaxially around said rod and having the respective ends thereof secured to respective end portions of said bladder assembly to define a water chamber inside said bladder;

a bladder pump check valve assembly operably connected to the upper end portion of said bladder assembly;

means for communicating an upper end of said bladder pump check valve assembly with a center conduit of a coaxial tubing arrangement;

a water passage extending through said universal check valve assembly, said hollow rod and water chamber of said bladder assembly, said bladder pump check valve assembly, said communicating means and said center conduit; and an air passage defined by an outer conduit of said coaxial tubing arrangement, said air passage extending through said top fitting outside of said communicating means, past outside portions of said bladder pump check valve assembly, and into a fluid chamber defined in said pump body outside said bladder.

41. A convertible groundwater device according to claim 40, wherein: said lifting means of said gas-drive pump comprises:

a substantially cylindrical and hollow top fitting selectively interchangeable with said bail adaptor for removable connection to said upper end of said pump body;

a water conduit disposed in said pump body;

means for communicating an upper end of said water conduit with a center conduit of a coaxial tubing arrangement;

a dip tube check valve assembly connected to a lower end of said water conduit;

a gas passage defined in part by an outer conduit of said coaxial tubing arrangement, said gas passage extending through said top fitting outside of said communicating means and into a fluid chamber defined in said pump body outside said water conduit.

42. A converter and variable-length groundwater device adapted to be converted from a first device to a second device, and vice versa, the first device having a type of fluid conveying system which is different from a fluid conveying system of the second device, and each of the first and second devices being of variable length, comprising:

at least one first fluid-conducting component which is common to each of said first and second devices;

at least one second fluid-conducting and length-extending component which is selectively connected to said first fluid-conducting common component to extend the length of said devices;

lifting means for lifting water from a well to be monitored; and means for removably connecting said lifting means with said fluid-conducting components.

43. A convertible and variable-length groundwater device according to claim 42, wherein:

said components and said lifting means are adapted to be interconnected without requiring the use of tools.

44. A convertible and variable-length groundwater device according to claim 42, wherein:

said first fluid-conducting component comprises a first elongated and substantially hollow universal pump body and a universal check valve assembly;

said at least one second fluid-conducting and length-extending component comprises a second elongated and substantially hollow universal pump body and a pump body coupler removably and sealingly connected between a lower end of said first pump body and an upper end of said second pump body; and said universal check valve assembly is removably connected to a lower end of said second pump body.

45. A convertible and variable-length groundwater device according to claim 44, wherein:

said first device comprises a variable-length bailer and said second groundwater device comprises a variable-length gas-drive pump.

46. A convertible and variable-length groundwater device according to claim 45, wherein:

said lifting means of said variable-length bailer comprises a substantially cylindrical and hollow bail adaptor removably connected to an upper end of said first pump body, and means for attaching a bail line to said bail adaptor.

47. A convertible and variable-length groundwater device according to claim 46, wherein:

said lifting means of said variable-length gas-drive pump comprises:

a substantially cylindrical and hollow top fitting selectively interchangeable with said bail adaptor for removable connection to said upper end of said first pump body;

first and second water conduits sealingly interconnected by a removable coupling member, said first water conduit being disposed in said first pump body and said second water conduit being disposed in said second pump body;

means for communicating an upper end of said first water conduit with a center conduit of a coaxial tubing arrangement;

a dip tube check valve assembly connected to a lower end of said second water conduit; and a gas passage defined in part by an outer conduit of said coaxial tubing arrangement, said gas passage extending through said top fitting outside of said communicating means and into a fluid chamber defined in said first and second pump bodies outside said interconnected first and second water conduits.

48. A convertible and variable-length groundwater device according to claim 44, wherein:

said first groundwater device comprises a variable-length bailer and said second groundwater device comprises a variable-length bladder pump.

49. A convertible and variable-length groundwater device according to claim 48, wherein:

said lifting means of said variable-length bailer comprises a substantially cylindrical and hollow bail adaptor removably connected to an upper end of said first pump body, and means for attaching a bail line to said bail adaptor.

50. A convertible and variable-length groundwater device according to claim 49, wherein:

said lifting means of said variable-length bladder pump comprises:

a substantially cylindrical and hollow top fitting selectively interchangeable with said bail adaptor for removable connection to said upper end of said first pump body;

first and second bladder assemblies, each said bladder assembly including a hollow rod provided with a plurality of apertures, and a flexible bladder arranged coaxially around said rod and having the respective ends thereof secure to respective end portions of said bladder assembly to define a water chamber inside said bladder;

an internal coupler sealingly and removably interconnected between a lower end portion of said first bladder assembly and an upper end portion of said second bladder assembly to provide fluid communication between said first and second bladder assemblies;

said first bladder assembly being disposed in said first pump body and said second bladder assembly being disposed in said second pump body;

a bladder pump check valve assembly operably connected to the upper end portion of said first bladder assembly;

means for communicating an upper end of said bladder pump check valve assembly with a center conduit of a coaxial tubing arrangement;

a water passage extending through said universal check valve assembly, said hollow rod and water chamber of said second bladder assembly, said internal coupler, said hollow rod and water chamber of said first bladder assembly, said bladder pump check valve assembly, said communicating means and said center conduit; and an air passage defined in part by an outer conduit of said coaxial tubing arrangement, said air passage extending through said top fitting outside of said communicating means, past outside portions of said bladder pump check valve assembly, into a first fluid chamber defined in said first pump body outside said bladder of said first bladder assembly, through said pump body coupler outside said internal coupler, and into a second fluid chamber defined in said second pump body outside said bladder of said second bladder assembly.

* * * * *

UNITED STATES PATENT AND TRADEMARK OFFICE

CERTIFICATE OF CORRECTION

PATENT NO. : 5,028,213

DATED : July 2, 1991

INVENTOR(S) : Dickinson et al

It is certified that error appears in the above-identified patent and that said Letters Patent is hereby corrected as shown below:

On the title page:
Abstract, on line 5, change "bailer" (second occurrence) to --bladder--;
" , line 10, change "bladder" (first occurrence) to --bailer--.
Column 3, line 29, change "gas-driven" to --gas drive--;
" , line 43, after "from" insert --a--.
Column 6, line 48, change "is" to --in--.
Column 7, line 6, delete the entire line after "other";
" , line 7,delete the first 7 words;
" , line 7, change "extend" to --extent--.
Column 8, line 17, change "engaged" to --engages--.
Column 9, line 34, change "thereof" to --thereon--.
Column 10, line 47, change "patterns" to --aperture--.
Column 12, line 31, change "time" to --timer--.
Column 13, line 37, change "30" to --10--.
Column 14, line 1, change "includes," to --include,--;
" , line 34, after "convenient" insert --order--;
" , line 56, change "Here again," to --Hereagain,--.
Column 15, line 21, change "20" to --10--;
" , line 45, change "of"(first occurrence) to --or--.
In the claims:
Claim 30, line 2, change "claim 28,"to --claim 29,--.

Signed and Sealed this

Third Day of November, 1992

*Attest:*

DOUGLAS B. COMER

*Attesting Officer*

*Acting Commissioner of Patents and Trademarks*